US009390705B2

(12) United States Patent
Tseng

(10) Patent No.: US 9,390,705 B2
(45) Date of Patent: Jul. 12, 2016

(54) INTELLIGENT SOUND FIELD CONTROL SYSTEM

(71) Applicant: Chee Henry Tseng, Hong Kong (CN)

(72) Inventor: Chee Henry Tseng, Hong Kong (CN)

( * ) Notice: Subject to any disclaimer, the term of this patent is extended or adjusted under 35 U.S.C. 154(b) by 50 days.

(21) Appl. No.: 14/515,305

(22) Filed: Oct. 15, 2014

(65) Prior Publication Data

US 2015/0208186 A1 Jul. 23, 2015

(30) Foreign Application Priority Data

Jan. 23, 2014 (CN) ..... 2014 1 0032319

(51) Int. Cl.
*H04R 29/00* (2006.01)
*G10K 11/35* (2006.01)
*E04B 1/99* (2006.01)

(52) U.S. Cl.
CPC ..... *G10K 11/357* (2013.01); *E04B 1/994* (2013.01); *H04R 29/002* (2013.01)

(58) Field of Classification Search
CPC ..... H04R 29/00
USPC ..... 381/160, 18
See application file for complete search history.

(56) References Cited

U.S. PATENT DOCUMENTS

2010/0119234 A1* 5/2010 Suematsu ..... H01Q 3/02 398/135
2014/0079223 A1* 3/2014 Nguyen ..... G01S 5/26 381/18

* cited by examiner

*Primary Examiner* — Duc Nguyen
*Assistant Examiner* — Phan Le

(57) ABSTRACT

An intelligent sound field control system, which relates to a sound field modulation device and is provided with a WiFi/wireless/wire network main control device, a notebook computer, a wireless universal serial bus dongle, a tablet computer, a motion control electronic device and a reflecting medium, is capable of integrally controlling states of different sound reflecting mediums. Accordingly, an indoor acoustic parameter can be varied and electromechanical integration can be achieved, thereby promoting usage convenience, accuracy and usability.

4 Claims, 2 Drawing Sheets

INTELLIGENT SOUND FIELD CONTROL SYSTEM

BACKGROUND OF THE INVENTION

1. Field of the Invention

The present invention relates to a sound field modulation device, and in particular relates to an intelligent sound field control system capable of integrally controlling states of different sound reflecting mediums to change an indoor acoustic parameter and to achieve electromechanical integration.

2. Description of the Related Art

Adjustable reverberant devices are essential to any specialized or multifunctional concert halls or indoor acoustic locations to achieve individual purposes of optimal acoustic index of music works such as reverberant time. That is, an acoustic adjustable device shall be necessarily provided to attain optimal acoustic index for different types of concerts, performances or meetings. At present, for the domestic concert halls that are provided with the adjustable sound field devices, methods of artificially adjusting sound reflecting medium states to change sound fields are generally applied. However, these methods has defects such as less intelligentization, long operation time, no memories with particular acoustic filed, insufficient accuracy and complications.

Wang Shiau-Dung, et al. (including Wang Shiau-Dung, MM Yi-Jian, Han Mau-Wei, Jang Wan-Ting, Chai Jing Jing; *The features analysis of the design and sound field of multifunctional concert halls*; Journal of Shaanxi Normal University (Natural Science Edition); 2011.06) disclosed the features analysis of the design and sound field of multifunctional concert halls.

CN1901760B Chinese patent discloses an acoustic sound field measuring device and an acoustic sound field measuring method. The acoustic sound field measuring device comprises a microphone set, a measuring unit and a position calculating unit. The microphone set has first and second spaced microphones that are designated to collect audio signals output from first and second speakers. The measuring unit is utilized to measure the distances of the first and second speakers and a distance between the first and second microphones in accordance with the audio signals collected by the first and second microphones. When the first speaker is taken as a standard position, the positions of the first and second microphones and the position of the second speaker can be calculated in accordance with corresponding measured distances.

BRIEF SUMMARY OF THE INVENTION

The main purpose of the invention is to provide an intelligent sound field control system, which is capable of integrally controlling states of different sound reflecting mediums to change an indoor acoustic parameter and to achieve electromechanical integration and promoting usage convenience, accuracy and usability.

The invention is provided with a WiFi/wireless/wire network main control device, a notebook computer, a wireless universal serial bus dongle, a tablet computer, a motion control electronic device and a reflecting medium. The WiFi/wireless/wire network main control device is respectively connected to an optional man-machine operation device notebook computer, the tablet computer and multiple sets of motion control electronic devices through an optional WiFi, or wireless or wire network, the wireless universal serial bus dongle is an optional wireless communication device that is utilized for connection of the man-machine operation device notebook computer, the tablet computer and the WiFi/wireless/wire network main control device, the WiFi/wireless/wire network main control device is utilized for response to a reflecting medium state control instruction transmitted from the notebook computer or the tablet computer, the reflecting medium state control instruction is accordingly utilized to control the corresponding motion control electronic device so that a purpose of collectively controlling each reflecting medium state can be attained and state information of each reflecting medium state can be fed back. An executive software, which is installed in a notebook computer or a tablet computer, is capable of memorizing reflecting plate state information in sets of scenes, conveniently setting scenes and providing excellent repeatability property. The WiFi, or wireless or wire network is an optional system communication. With the configuration of the servo electrical machine or step electrical machine, transmission mechanisms and sensors, the motion control electronic device can precisely control rotation angle, inclination angle and height of the reflecting mediums to change the indoor sound field.

At least one of a flat-plate type reflecting plate array, a reflecting triangle conformation array, and a suspension type spherical reflecting plate array is adopted by the reflecting medium.

The flat-plate type reflecting plate comprises a first surface formed as a reflective material layer and a second surface formed as an acoustic absorptive material layer.

Three surfaces of the reflecting triangle conformation are formed as material layers provided with different acoustic absorptive coefficients.

The suspension type spherical reflecting plate comprises a lower part formed as a reflective material layer and an upper part formed as an acoustic absorptive material layer.

By cooperating system communication of the WiFi, or wireless or wire network with electromechanical controls and applying adjustable acoustic filed control, a precise control of acoustic filed can be realized. Besides, with the different adjusted sound fields capable of being controlled and fed back through the computer, excellent repeatability property and operation convenience can be attained.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The present invention can be more understood by reading the subsequent embodiment with references made to the accompanying drawings.

Figure 1:
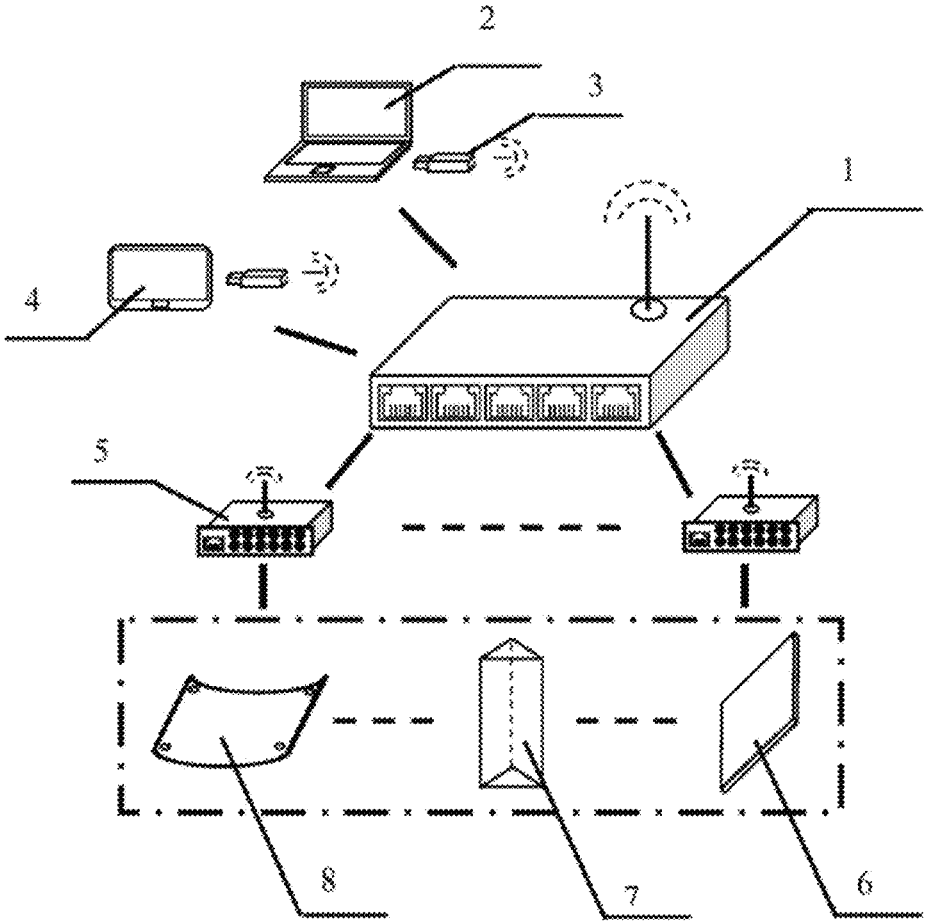
FIG. 1 is a constitution diagram of an entire structure of an embodiment of the invention.

FIG. 1 is a constitution diagram of an entire structure of an embodiment of the invention, in which a WiFi/wireless/wire network main control device 1, a notebook computer 2, a wireless universal serial bus dongle 3, a tablet computer 4, a motion control electronic device 5, at least one of a flat-plate type reflecting plate array 6, a reflecting triangle conformation array 7 and a suspension type spherical reflecting plate array 8 are provided. The WiFi/wireless/wire network main control device 1 is respectively connected to an optional man-machine operation device notebook computer, the tablet computer 4 and multiple sets of motion control electronic devices through an optional WiFi, or wireless or wire network. The wireless universal serial bus dongle 3 is an optional wireless communication device that is utilized for connection of the man-machine operation device notebook computer, the tablet computer 4 and the WiFi/wireless/wire network main control device 1.

Figure 2:
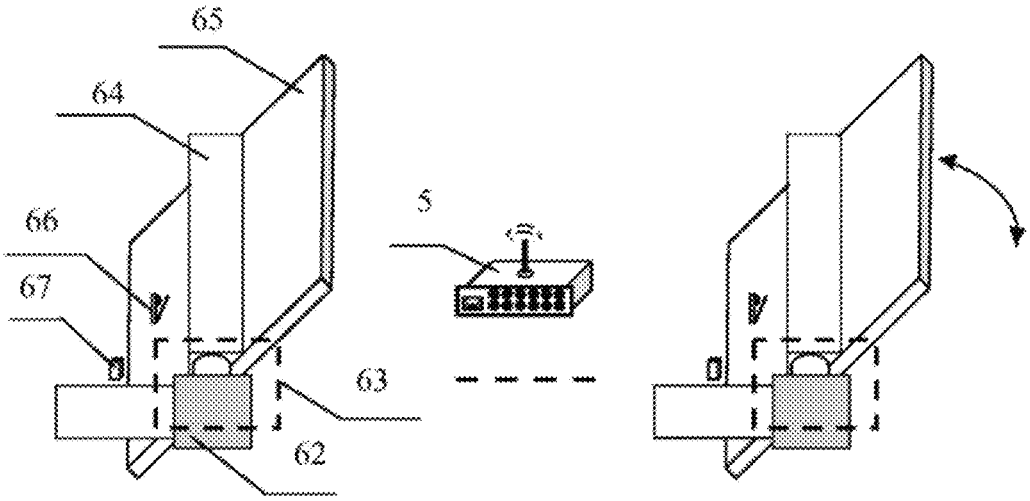
FIG. 2 is a control structure diagram of a flat-plate type reflecting plate array of an embodiment of the invention.

FIG. 2 is a control structure diagram of a flat-plate type reflecting plate array of the embodiment of the invention, in which a servo electrical machine or step electrical machine 62, a rotary machinery structure 63, a rotary arm 64, a flat-plate type reflecting plate 65, a position-limiting switch 66 and a starting point sensor 67 are provided. In FIG. 2, a sign '5' represents a motion control electronic device.

The motion control electronic device 5, which is coupled to the servo electrical machine or step electrical machine 62, the position-limiting switch 66 and the starting point sensor 67, is utilized to control or stop the rotation of the servo electrical machine or step electrical machine 62. The servo electrical machine or step electrical machine 62 is coupled to the rotary arm 64 through the rotary machinery structure 63. The rotary machinery structure 63 is coupled to the servo electrical machine or step electrical machine 62 and the flat-plate type reflecting plate 65 by using the direct drive of the electrical machine and transmission box or the chain drive or gear drive. The servo electrical machine or step electrical machine 62 is fixed on the rotary arm 64, and the position-limiting switch 66 and the starting point sensor 67 are configured on one side of the flat-plate type reflecting plate 65.

Initial original point information of the flat-plate type reflecting plate 65 is fed back to the motion control electronic device 5 through the starting point sensor 67.

The position-limiting switch 66 is a safety protection device directly coupled to a power supply source of the system.

Figure 3:
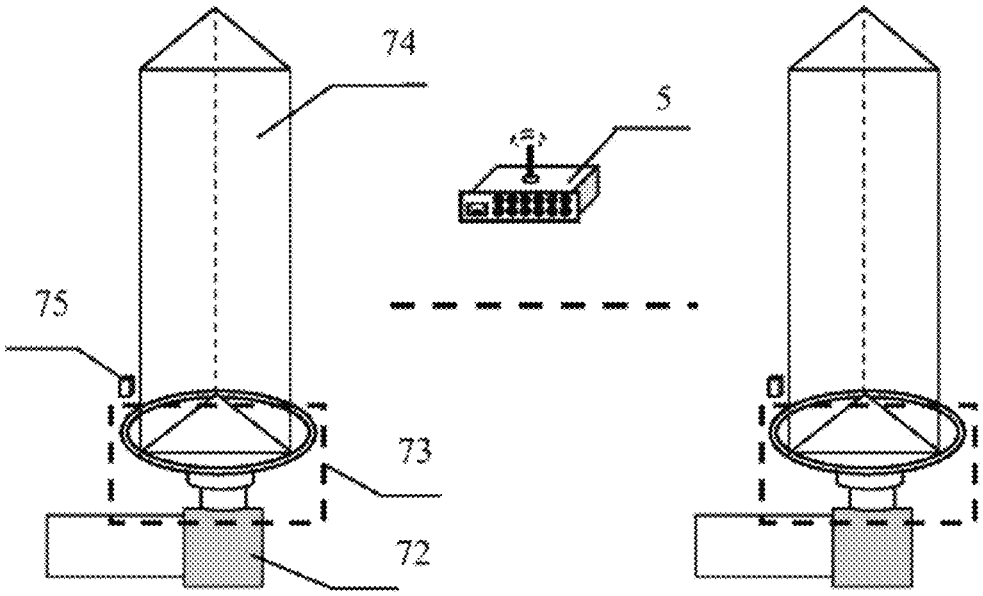
FIG. 3 is a control structure diagram of a reflecting triangle conformation array of an embodiment of the invention.

FIG. 3 is a control structure diagram of a reflecting triangle conformation array the invention, in which a servo electrical machine or step electrical machine 72, a rotary machinery structure 73, a reflecting triangle conformation 74 and a datum point sensor 75 are provided. In FIG. 3, a sign '5' represents a motion control electronic device.

The motion control electronic device 5, which is coupled to the servo electrical machine or step electrical machine 72 and the datum point sensor 75, is utilized to control or stop the rotation of the servo electrical machine or step electrical machine 72.

The rotary machinery structure 73 is coupled to the servo electrical machine or step electrical machine 72 and the reflecting triangle conformation 74, capable of using the direct drive of the electrical machine and transmission box or the chain drive or gear drive. The datum point sensor 75 is configured on one side of the reflecting triangle conformation 74. Initial original point information of the reflecting triangle conformation 74 is fed back to the motion control electronic device 5 through the datum point sensor 75.

Figure 4:
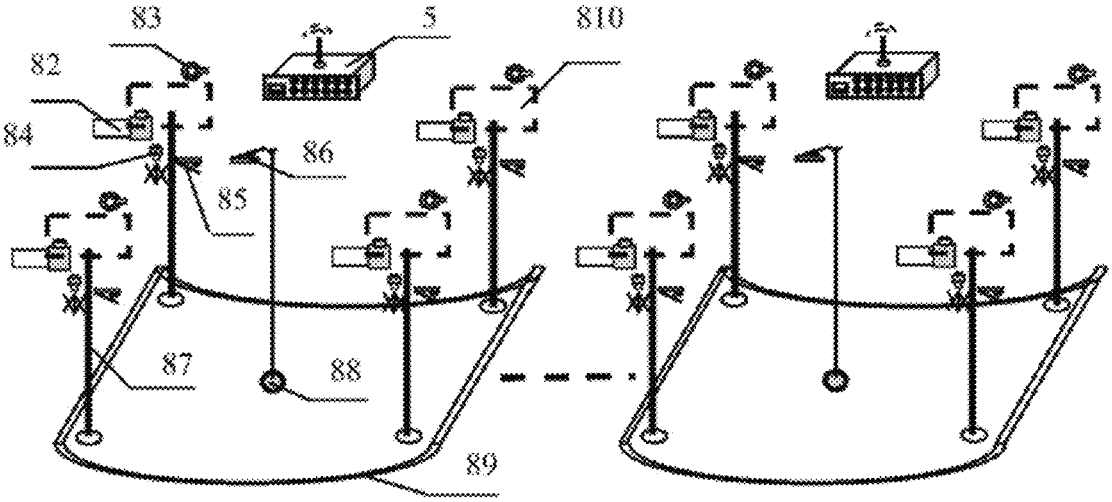
FIG. 4 is a control structure diagram of a suspension type spherical reflecting plate array of an embodiment of the invention.

FIG. 4 is a control structure diagram of a suspension type spherical reflecting plate array of the invention, in which a servo electrical machine or step electrical machine 82, a counting encoder 83, an original point sensor 84, a position-limiting switch 85, a protection switch 86, a steel wire rope/chain 87, a floating ball 88, a suspension type spherical reflecting plate 89 and a rotary machinery structure 810 are provided. In FIG. 4, a sign '5' represents a motion control electronic device.

The motion control electronic device 5, which is coupled to the servo electrical machine or step electrical machine 82, the counting encoder 83, the original point sensor 84, the position-limiting switch 85 and the protection switch 86, is utilized to control or stop the rotation of the servo electrical machine or step electrical machine 82. The servo electrical machine or step electrical machine 82 is configured on an upper end of the steel wire rope/chain 87 through the rotary machinery structure 810, the upper end of the steel wire rope/chain 87 is coupled to an upper surface of the suspension type spherical reflecting plate 89, and the floating ball 88 is configured above the suspension type spherical reflecting plate 89.

Height information of the suspension type spherical reflecting plate 89 is fed back to the motion control electronic device 5 through the counting encoder 83.

Initial original point information of the suspension type spherical reflecting plate 89 is fed back to the motion control electronic device 5 through the original point sensor 84.

The position-limiting switch 85 and the protection switch 86 are formed as a safety protection device directly coupled to a power supply source of the system.

What is claimed is:

1. An intelligent sound field control system characterized in that a WiFi/wireless/wire network main control device, a notebook computer, a wireless universal serial bus dongle, a tablet computer, a motion control electronic device and a reflecting medium are provided, the WiFi/wireless/wire network main control device is respectively connected to an optional man-machine operation device notebook computer, the tablet computer and multiple sets of motion control electronic devices through an optional WiFi, or wireless or wire network, the wireless universal serial bus dongle is an optional wireless communication device that is utilized for connection of the man-machine operation device notebook computer, the tablet computer and the WiFi/wireless/wire network main control device, the WiFi/wireless/wire network main control device is utilized for response to a reflecting medium state control instruction transmitted from the notebook computer or the tablet computer, the reflecting medium state control instruction is accordingly utilized to control the corresponding motion control electronic device so that a purpose of collectively controlling each reflecting medium state can be attained and state information of each reflecting medium state can be fed back, and the WiFi, or wireless or wire network is an optional system communication, characterized in that at least one of a flat-plate type reflecting plate array, a reflecting triangle conformation array, and a suspension type spherical reflecting plate array is adopted by the reflecting medium, wherein i) the flat-plate type reflecting plate array includes a servo electrical machine or step electrical machine, a rotary machinery structure, a rotary arm, a flat-plate type reflecting plate, a position-limiting switch and a starting point sensor:

the motion control electronic device, which is coupled to the servo electrical machine or step electrical machine, the position-limiting switch and the starting point sensor controls, or stops, rotation of the servo electrical machine or step electrical machine, the servo electrical machine or step electrical machine is coupled to the rotary arm through the rotary machinery structure, the rotary machinery structure is coupled to the servo electrical machine or step electrical machine and the flat-plate type reflecting plate by using the direct drive of the electrical machine and transmission box or the chain drive or gear drive; and the servo electrical machine or step electrical machine is fixed on the rotary arm, and the position-limiting switch and the starting point sensor are configured on one side of the flat-plate type reflecting plate;

ii) the reflecting triangle conformation array includes a servo electrical machine or step electrical machine, a rotary machinery structure, a reflecting triangle conformation and a datum point sensor:

the motion control electronic device, which is coupled to the servo electrical machine or step electrical machine and the datum point sensor controls, or stops, rotation of the servo electrical machine or step electrical machine, the rotary machinery structure is coupled to the servo electrical machine or step electrical machine and the reflecting triangle conformation, capable of using the direct drive of the electrical machine and transmission box or the chain drive or gear drive;

the datum point sensor is configured on one side of the reflecting triangle conformation, Initial original point information of the reflecting triangle conformation is fed back to the motion control electronic device through the datum point sensor; and iii) the suspension type spherical reflecting plate array, includes a servo electrical machine or step electrical machine, a counting encoder, an original point sensor, a position-limiting switch, a protection switch, a steel wire rope/chain, a floating ball, a suspension type spherical reflecting plate and a rotary machinery structure:

the motion control electronic device, which is coupled to the servo electrical machine or step electrical machine, the counting encoder, the original point sensor , the position-limiting switch and the protection switch controls, or stops, rotation of the servo electrical machine or step electrical machine, the servo electrical machine or step electrical machine is configured on an upper end of the steel wire rope/chain through the rotary machinery structure, the upper end of the steel wire rope/chain is coupled to an upper surface of the suspension type spherical reflecting plate, and the floating ball is configured above the suspension type spherical reflecting plate.

2. The intelligent sound field control system as claimed in claim 1 characterized in that the flat-plate type reflecting plate comprises a first surface formed as a reflective material layer and a second surface formed as an acoustic absorptive material layer.

3. The intelligent sound field control system as claimed in claim 1 characterized in that three surfaces of the reflecting triangle conformation are formed as material layers provided with different acoustic absorptive coefficients.

4. The intelligent sound field control system as claimed in claim 1 characterized in that the suspension type spherical reflecting plate comprises a lower part formed as a reflective material layer and an upper part formed as an acoustic absorptive material layer.

* * * * *